US007438017B2

(12) United States Patent
Jabbari et al.

(10) Patent No.: US 7,438,017 B2
(45) Date of Patent: Oct. 21, 2008

(54) METHOD AND APPARATUS TO COLOR VINYL SLATS

(76) Inventors: Cyrus A. Jabbari, 10238 Brittenford Dr., Vienna, VA (US) 22182; Edwin Morales, 742 Linden St., Fresno, TX (US) 77545

( * ) Notice: Subject to any disclaimer, the term of this patent is extended or adjusted under 35 U.S.C. 154(b) by 39 days.

(21) Appl. No.: 10/974,164

(22) Filed: Oct. 27, 2004

(65) Prior Publication Data

US 2006/0088664 A1 Apr. 27, 2006

(51) Int. Cl.
*B05C 11/00* (2006.01)

(52) U.S. Cl. ..... 118/44; 118/46

(58) Field of Classification Search ..... 118/109, 118/203, 261, 413, 216, 44, 46, 249, 114–117, 118/103–104, 264; 15/256.5, 256.51; 425/229–230; 101/350.6, 423, 425
See application file for complete search history.

(56) References Cited

U.S. PATENT DOCUMENTS 4,165,965 A * 8/1979 Bernardelli et al. ..... 432/75
4,231,653 A * 11/1980 Nagahara et al. ..... 399/325
5,142,122 A * 8/1992 Ariyama ..... 219/216
5,505,128 A * 4/1996 van den Brink ..... 101/219
5,826,509 A * 10/1998 Deneka ..... 101/366
5,879,514 A * 3/1999 Meschenmoser ..... 162/272
6,471,773 B1 * 10/2002 Atkins ..... 118/123
6,668,715 B1 * 12/2003 Biro et al. ..... 101/32
2002/0088356 A1 * 7/2002 Van Den Brink et al. .... 101/219

FOREIGN PATENT DOCUMENTS

JP 61-286135 * 12/1986 ..... 118/261

* cited by examiner

*Primary Examiner*—Brenda A. Lamb

(57) ABSTRACT

A method and apparatus for coloring slats utilizes a roller, such as an Anilox roller, and enclosed doctor blade subassembly for metering an amount of colorant transferred to the object, and a felt-wiper subassembly for removing colorant from a roller, such as a discharge roller. The doctor blade subassembly includes a pair of side plates located at opposing ends of a doctor blade to enclose a portion of the roller and prevent colorant from building up on a side of the roller while the colorant is being applied to the roller and as excess colorant is being scraped off by the doctor blade. The felt-wiper subassembly includes a wiper blade and a felt insert that combine effectively to remove colorant that is deposited on a roller, such as a discharge roller, that contacts the object once the colorant has been transferred to the object.

9 Claims, 9 Drawing Sheets

FIG. 7
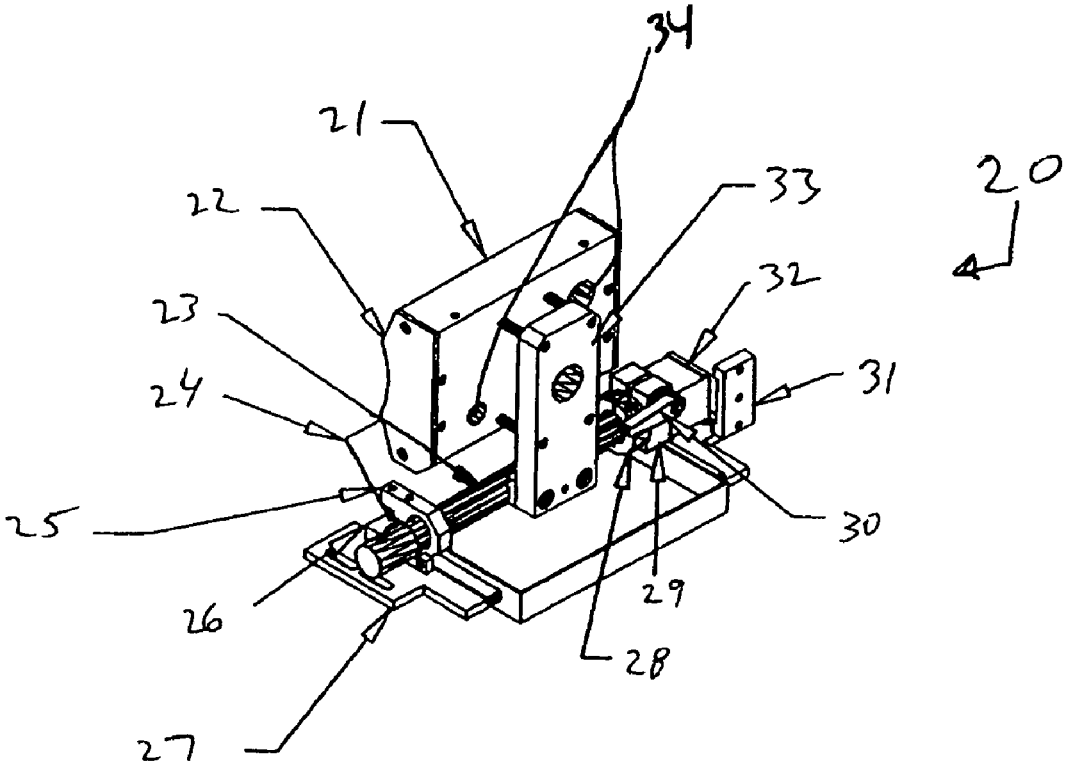
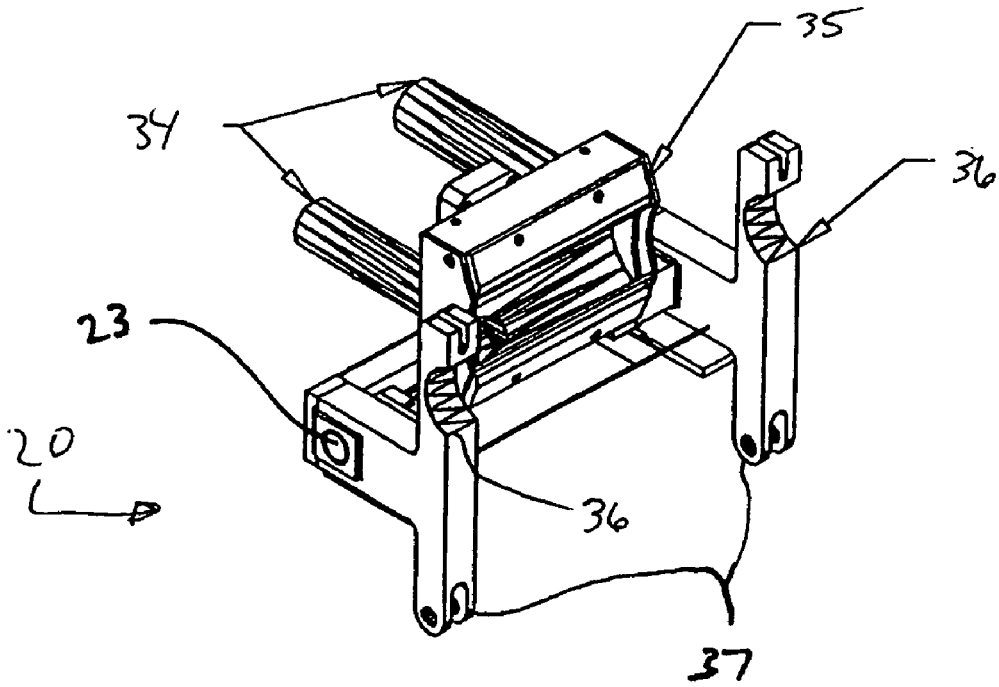
FIG. 8

METHOD AND APPARATUS TO COLOR VINYL SLATS

BACKGROUND OF THE INVENTION

1. Field of the Invention

The present invention relates generally to the coloring of various manufactured articles. More particularly, the present invention relates to methods and apparatus for coloring the surfaces of generally planar articles, such as vinyl slats used to manufacture window blinds.

2. Discussion of the Related Art

Vertical and horizontal blinds are commonly used as treatments for covering openings, windows, doors, and the like. Such blinds are comprised of generally planar slats, which serve several purposes. Typically, the slats are adjustable to selectively filter light or air, for example. Blinds are also used for aesthetic or decorative purposes. The slats used to manufacture blinds can be formed from a number of materials including wood, metal, polyvinyl chloride (PVC) or similar materials. PVC slats are typically formed by selectively extruding molten PVC material to the desired shape.

To add to the aesthetic appearance of the slats, it is common to create unique surfaces on the slats, such as intricate textured, patterned or colored surfaces. Creation of such unique surface textures and patterns are especially beneficial for use with materials, such as metal and PVC, which do not naturally include as aesthetically pleasing appearances as do organic materials, such as wood. The coloring or coating of slat surfaces is extremely desirable because it adds to the aesthetic appearance, as well as increases the durability of the slats. Methods to apply coloring to the surfaces of slats are well known. In one such method, a slat is fed through a machine that includes a series of rollers for embossing and applying a colorant, such as ink, to the surface of the slat. In such a machine the amount of ink applied to the slat is metered through the use of an Anilox roller. Maintaining an adequate amount of ink, evenly distributed over the entire surface of the Anilox roller is extremely important. Too little or too much ink results in an undesirable final appearance for the slat. In addition, it is important to keep excess ink from building up on other rollers and components of the machine. There exists a need in the industry for a method and apparatus of coloring generally planar objects, such as slats, that evenly distributes an optimum amount of colorant over the surface of the object and which minimizes the build up of excess ink on machine components. There is also a need for an apparatus for coloring generally planar objects, such as slats, in which the components are easy to remove for cleaning and maintenance of the machine.

SUMMARY OF THE INVENTION

Accordingly the present invention comprises methods and apparatus for coloring the surfaces of generally planar articles, such as vinyl slats. The apparatus of the present invention includes an Anilox roller and enclosed doctor blade subassembly for metering an amount of colorant transferred to the object, and a felt-wiper subassembly for removing colorant from a roller, such as a discharge roller. The doctor blade subassembly includes a pair of side plates located at opposing ends of a doctor blade to enclose a portion of the Anilox roller and prevent colorant from building up on a side of the Anilox roller while the colorant is being applied to the roller and as excess colorant is being scraped off by the doctor blade. The felt-wiper subassembly includes a wiper blade and a felt insert that combine effectively to remove colorant that is deposited on a roller, such as a discharge roller, that contacts the object once the colorant has been transferred to the object.

These and other objects and advantages of the present invention will be classified in the following description of the preferred embodiment in connection with the drawings, the disclosure and the appended claims, wherein like reference numerals represent like elements throughout. The drawings constitute a part of this application and include exemplary embodiments of the present invention and illustrate various features thereof.

BRIEF DESCRIPTION OF THE DRAWINGS

FIG. 7 is a front perspective view of an Anilox roller and enclosed doctor blade subassembly of the ink machine shown in FIG. 1.

FIG. 8 is a rear perspective view of the Anilox roller and enclosed doctor blade subassembly of FIG. 7.

DETAILED DESCRIPTION OF A PREFERRED EMBODIMENT

Figure 1:
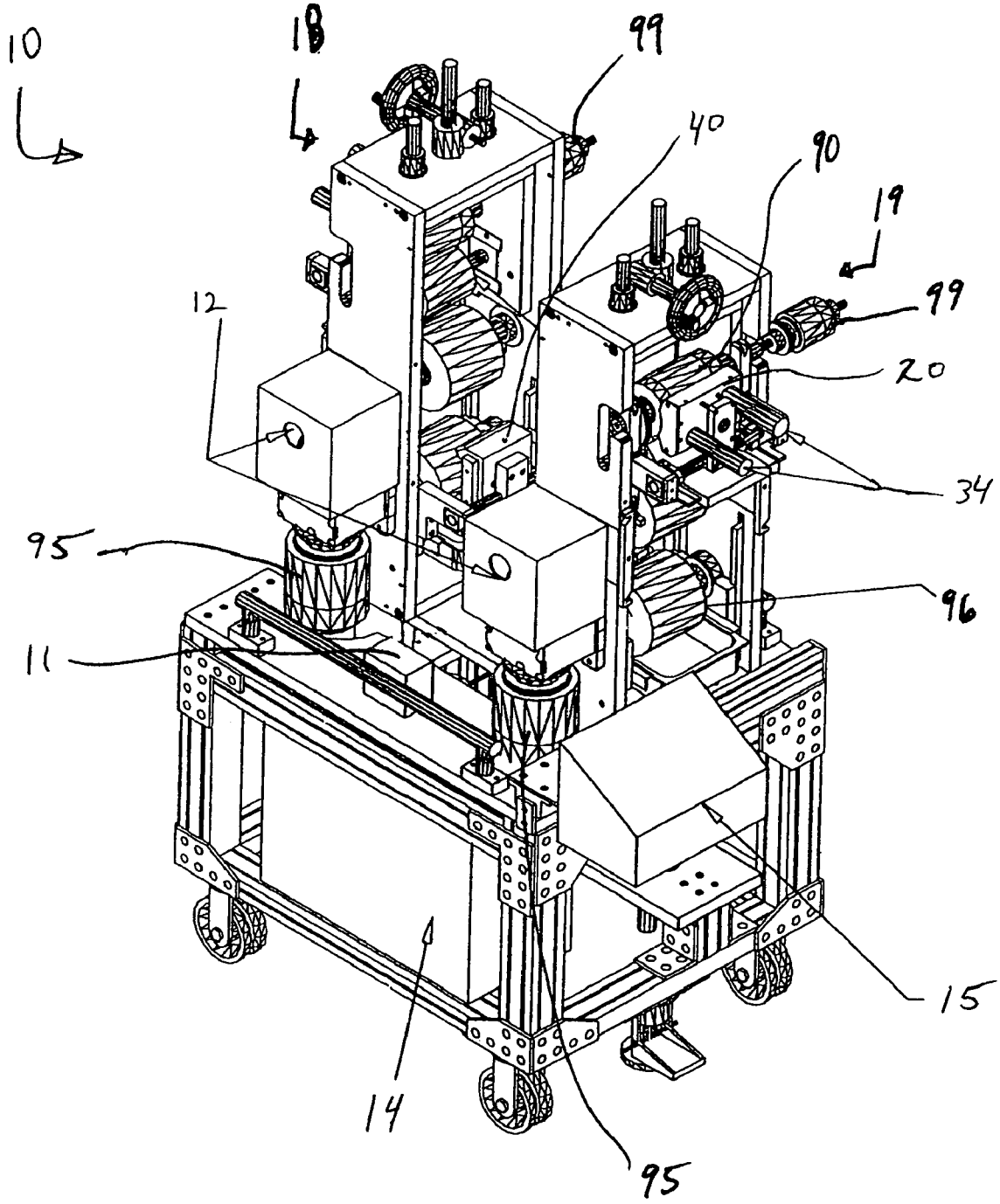
FIG. 1 is a front perspective view of an ink machine apparatus embodiment of the present invention.

While the present invention may be embodied in many different forms, there is shown in the drawings and discussed herein a specific embodiment with the understanding that the present disclosure is to be considered only as an exemplification of the principles of the invention and is not intended to limit the invention to the embodiments illustrated.

Figure 2:
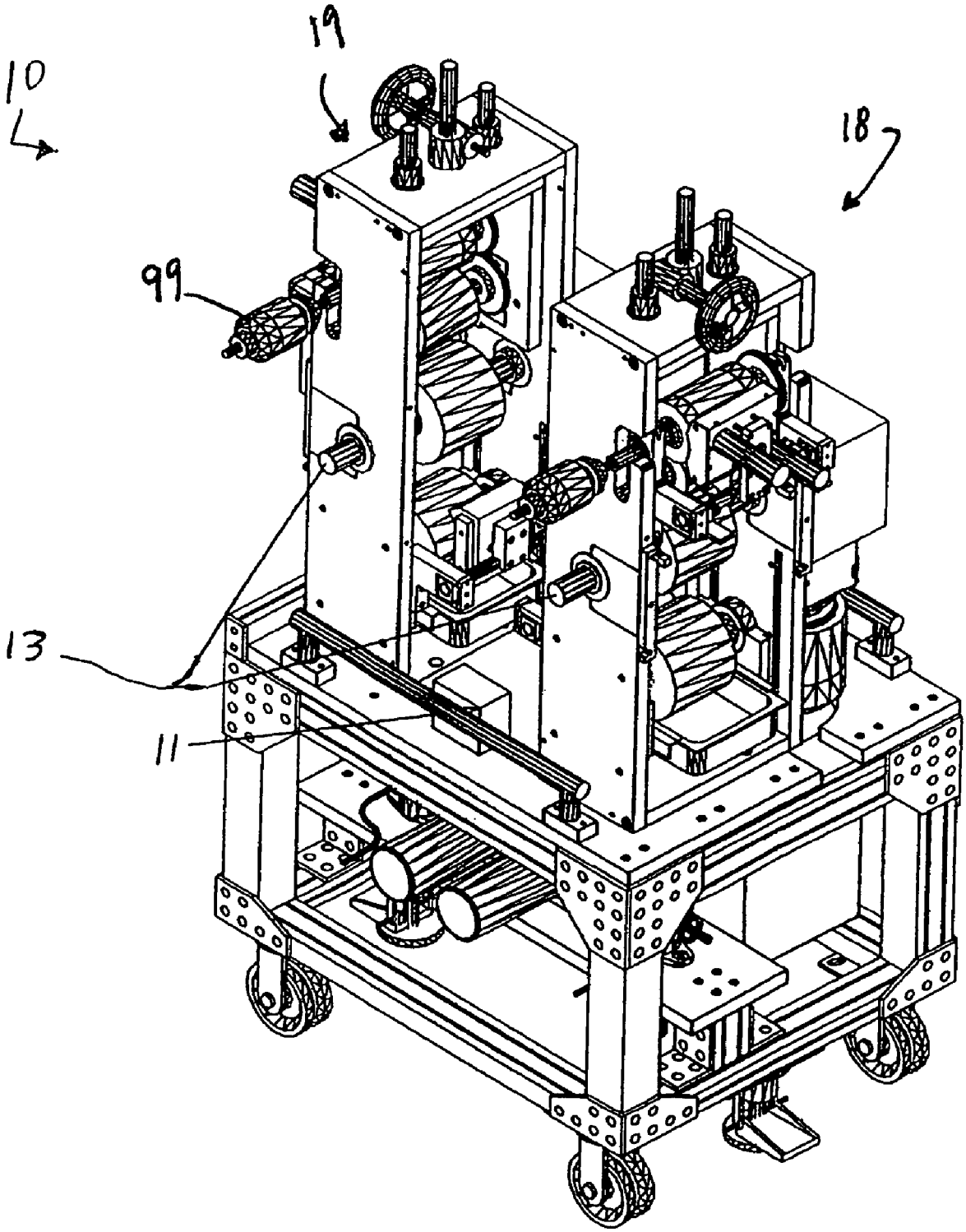
FIG. 2 is a rear perspective view of the ink machine of FIG. 1.

Referring to the drawings in greater detail, FIGS. 1 and 2 show an exemplary embodiment of the instant invention of a machine, 10, for coloring vinyl slats including two opposing roller assemblies, 18 and 19, an electrical panel, 14, providing power to the components of machine 10, an operator's control panel, 15, and three (3) emergency stop buttons, one such button, 11, being shown.

Roller assembly 18 includes generally the same components, and is constructed in generally the same manner as roller assembly 19, with the exception being that roller assembly 18 is assembled and positioned on machine 10 so as to virtually mirror roller assembly 19. For purposes of simplicity, the components of both roller assemblies are discussed in detail with reference primarily to a single roller assembly, with like numbers referring to the same or similar components on both roller assemblies 18 and 19. It will be appreciated that although machine 10 includes two generally similar roller assemblies, a machine with more than or less than two roller assemblies, or a machine in which the shapes, sizes and arrangement of roller assemblies 18 and 19 vary from one another, is also contemplated to be within the scope of the instant invention. It will further be appreciated that roller assemblies 18 and 19 may be arranged together such that a single slat winds its way through both roller assemblies 18 and 19 to complete the coloring (and embossing, if desired) process, or alternatively, rollers assemblies 18 and 19 may be arranged to work independent from one another.

Each of roller assemblies 18 and 19 includes a frame unit supporting a plurality of rollers, a doctor blade subassembly, 20, associated with an Anilox roller, 90, and a felt-wiper subassembly, 40, associated with a discharge roller, 11. The roller assemblies are each powered by an air motor, 99, and a gear motor, 95. Chill water entries 12 supply coolant to embossing rollers 94 of roller assemblies 18 and 19, and chill water returns 13 discharge the coolant from the roller assemblies.

Figure 3:
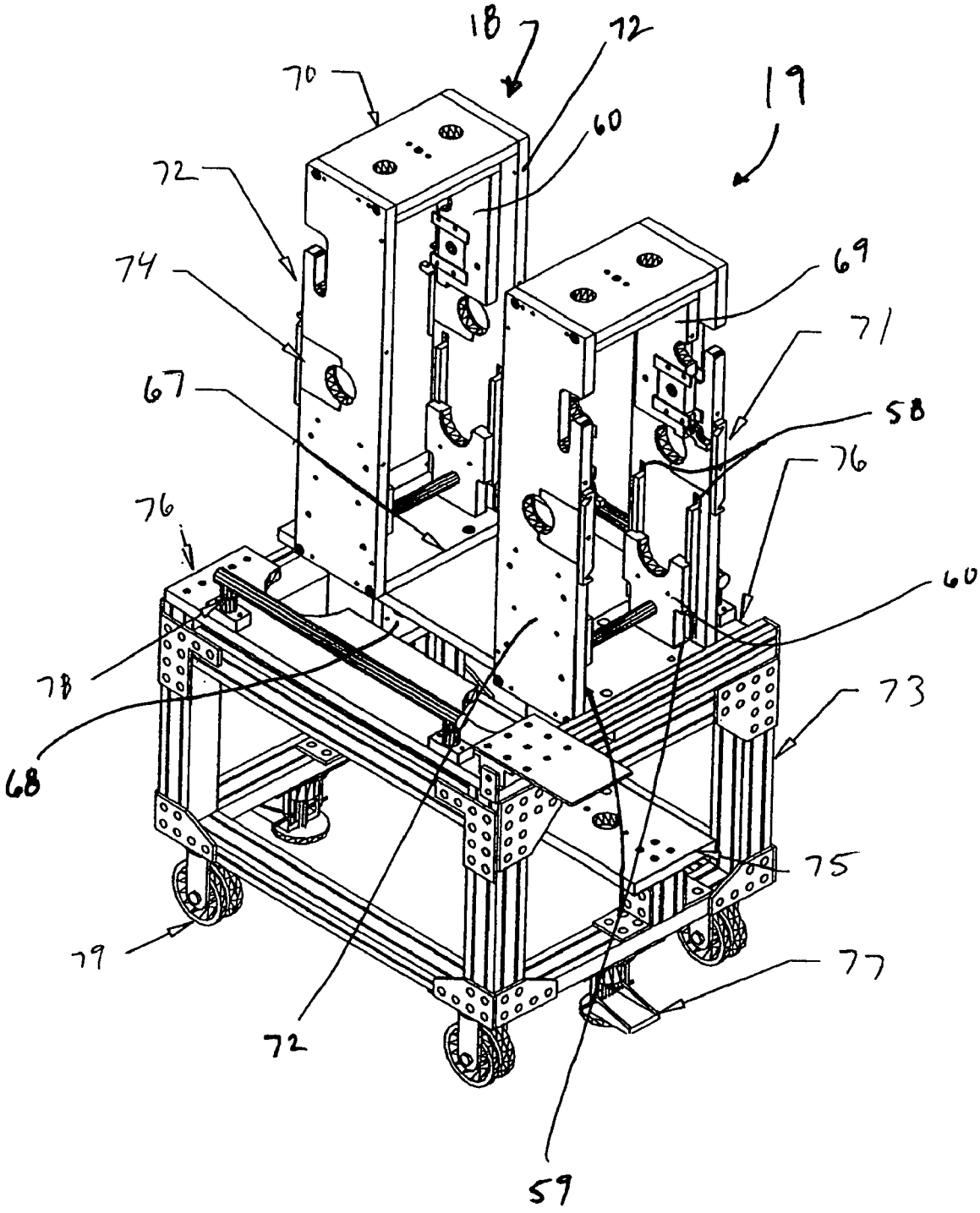
FIG. 3 is a partial front perspective view of the ink machine of FIG. 1 showing the frame unit of the ink machine.
Figure 4:
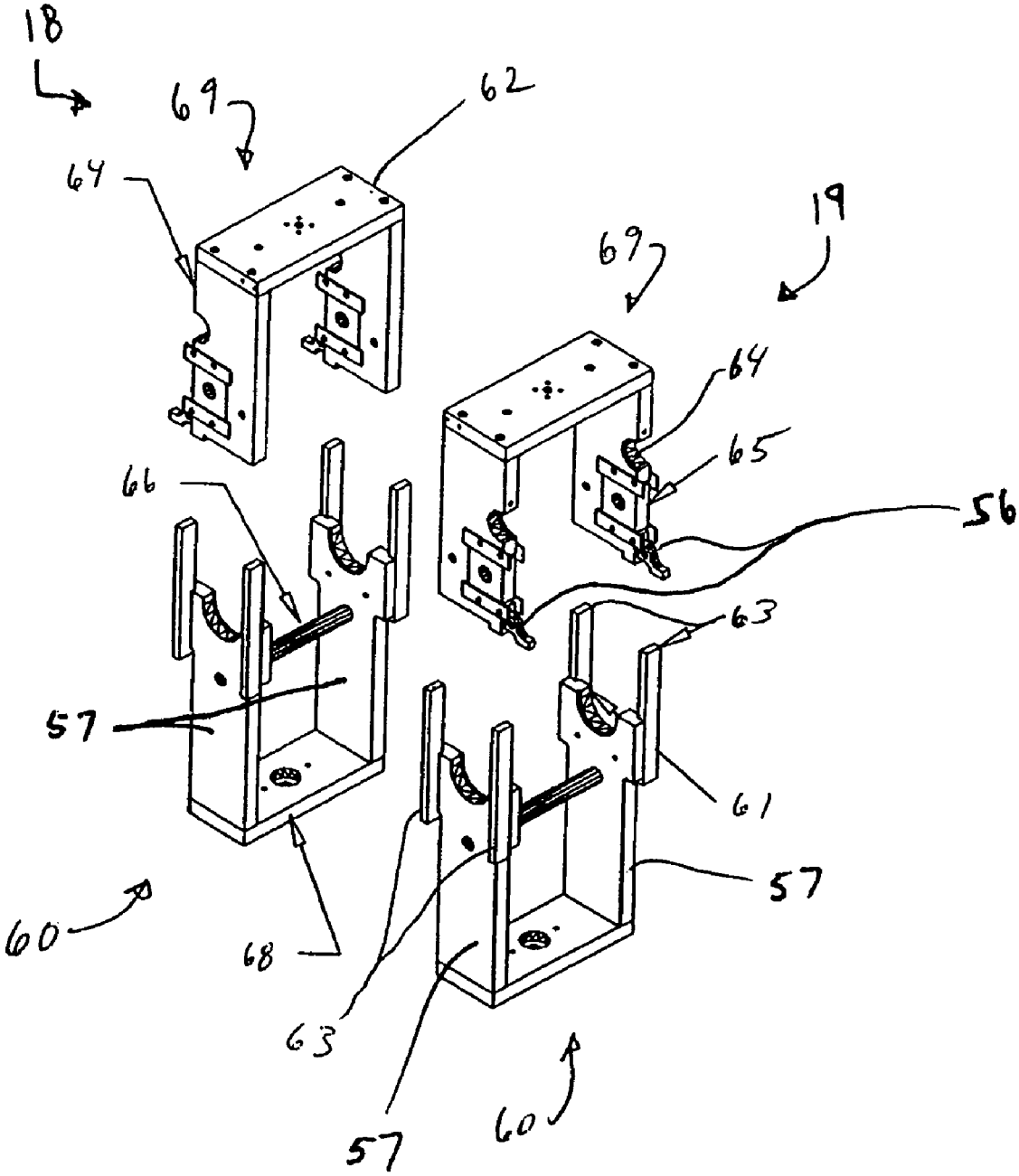
FIG. 4 is an exploded front perspective view of the roller support frame subassembly of the ink machine shown in FIG. 1.

Referring to FIGS. 3 and 4, the frame units for roller assemblies 18 and 19 each includes a fixed outer frame and a two-piece adjustable roller support frame. As is shown in FIG. 3, the outer support frame for each of roller assemblies 18 and 19 includes a top plate, 70, connected to side plates 72, which are mounted to bottom plate 67. Bottom plate 67 is mounted to stand base plate 76 which is mounted on top of machine base 73. Side plates 72 are also attached to bottom plate 76 to provide additional structural support to the outer frame of the roller assembly. Bottom plate 67 and base plate 76 include cutouts 59 to allow sides plates 57 of bottom piece 60 of the two-piece roller support frame to extend through bottom plate 67 and base plate 76 to allow for vertical adjustment of bottom portion 60 of the roller support frame. Machine base 73 comprises a framework to which casters 79 are attached for moving machine 10, and to which floor locks 77 are attached for securing machine 10 in position during operation. Handles 78 are attached to base plates 76 for grasping machine 10 while it is being moved. Plate 75 is also attached to the framework of machine base 73 for supporting a mechanism for lifting bottom portion 60 of the roller support frame.

The adjustable roller support frame of each roller assembly fits within the fixed outer frame described above. As is shown in greater detail in FIG. 4, each adjustable roller support frame includes top portion 69 and bottom portion 60. The two-piece design allows top portion 69 and bottom portion 60 to each be adjusted vertically independent of one another. Bottom portion 60 of the internal support frame includes two side plates, 57, connected together by cross bar 66. Side plates 57 include roller cradle 61 for supporting a roller, and slide bars 63. Slide bars 63 fit and are slidable up and down within grooves 58 that are cut into the inner faces of side plates 72 of the outer support frame. Sides plates 57 extend through bottom plate 67 and base plate 76 to sit on top of plate 68, which is adjustable vertically the lifting mechanism located on lifting unit support plate 75. Top portion 69 of the internal support frame includes top plate 62 connected to two side plates. As is shown in FIG. 5, top plate 62 is also connected to a lift mechanism, 80, to control vertical adjustment of top portion 69 relative to top plate 70 of the outer frame.

Figure 5:
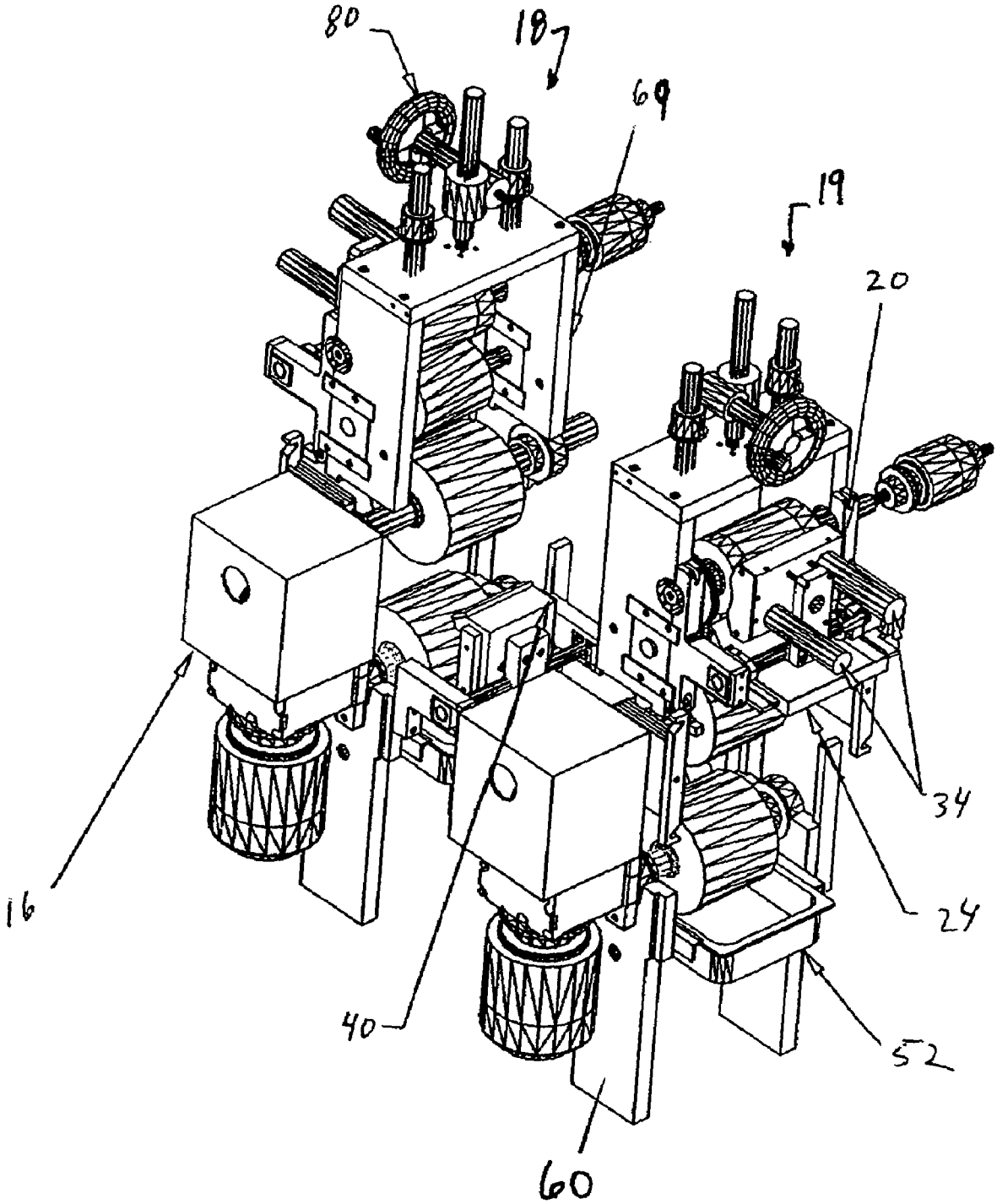
FIG. 5 is a partial front perspective view of the ink machine of FIG. 1 showing an assembled roller unit of the ink machine.
Figure 6:
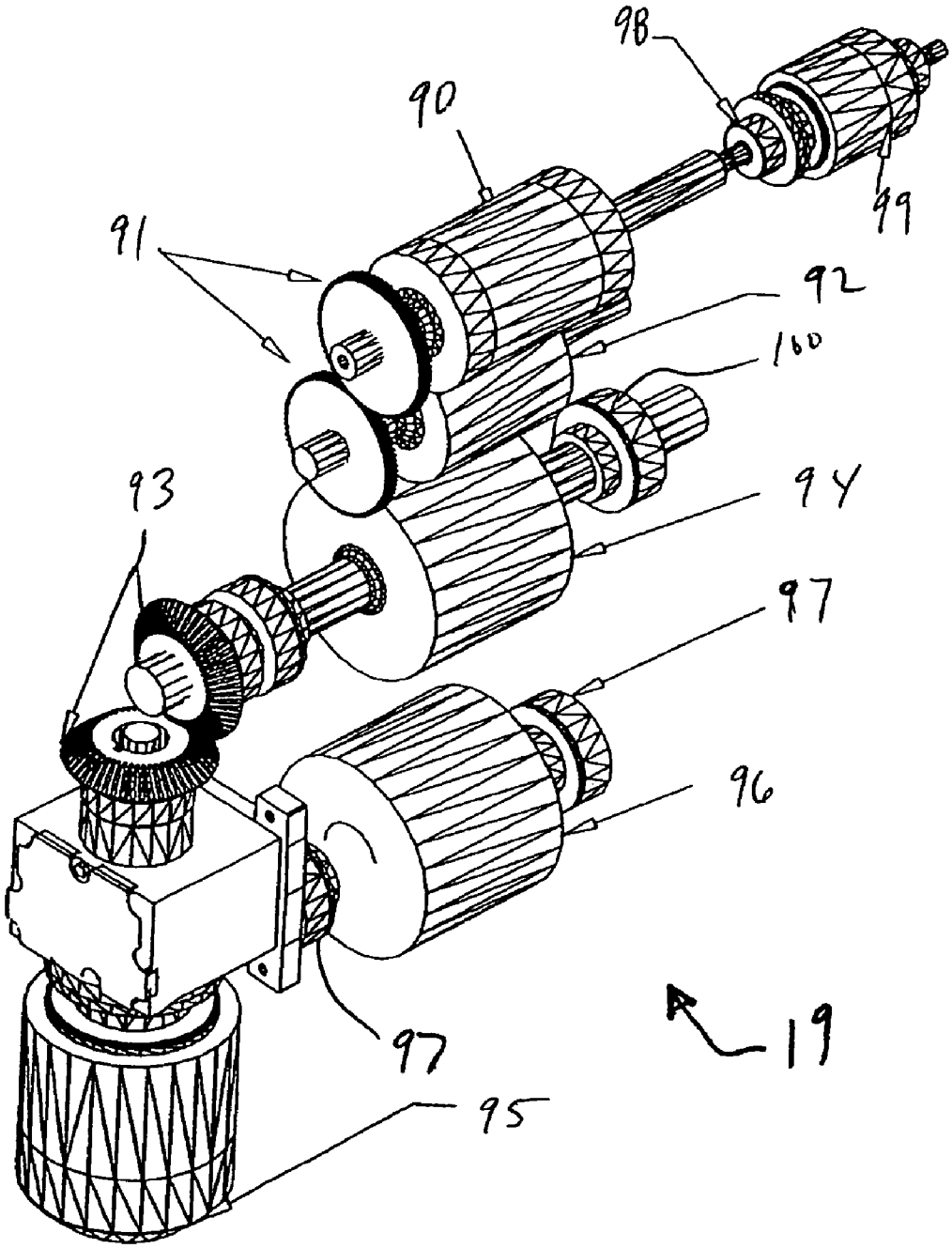
FIG. 6 is an enlarged front perspective view of the roller unit of FIG. 5 showing the gear transmission and roller subassembly for the right half of the ink machine shown in FIG. 1.

Referring to FIGS. 5 and 6, the arrangement of the two-piece adjustable roller support frame, portions 60 and 69, in connection with the rollers it supports is shown. FIG. 5 shows portions 60 and 69 with the rollers installed, and FIG. 6 shows the arrangement of the rollers of roller assembly 19 in detail with the frame being removed. As is shown in FIG. 6, roller assembly 19 includes an Anilox roller 90, a transfer roller 92, an embossing roller 94, and a bottom (discharge/embossing) roller 96. Anilox roller 90 is supported within top portion 69 of the inner support frame by bearing support 64, and transfer roller 92 is supported within top portion 69 of the inner support frame by bearing support 65, such that both rollers are vertically adjustable as a single unit. Anilox roller 90 is connected to air motor 99 for rotation of Anilox roller 90. Air motor 99 is supported to a frame (not shown) by bearing 98. Anilox roller 90 is connected to transfer roller 92 by spur gears 91, so that transfer roller 92 is rotated by air motor 99 at a rate directly proportional to the rate of rotation of Anilox roller 90. A colorant, such as ink or paint is applied to Anilox roller 90 through ink ports 34 located in doctor blade unit 20 as the roller rotates. Doctor blade unit 20 ensures that any ink in excess of a desired amount is removed from Anilox roller 90, and the metered amount of ink is then dropped onto transfer roller 92 as both rollers 90 and 92 rotate. The ink is then transferred from transfer roller 92 to a slat that is fed through machine 10.

Embossing roller 94 is supported to the outer support frame so that it is not vertically adjustable. Roller 94 is supported by bearings 100 that are removably positioned within side plates 72 by insert bearing covers 74. Bearing covers 74 are held in position by locking bars 71. Embossing roller 94 is rotated by gear motor 95 that is connected to roller 94 by sprocket gears 93. Gear motor 95 is mounted to the outer surface of side plate 72, and cover box 16 is placed over sprockets 93 to minimize operator exposure to the gears. Lift mechanism 80 controls the vertical adjustment of transfer roller 92 relative to embossing roller 94 so that the pressure between transfer roller 92 and embossing roller 94 may be adjusted to an amount desirable to achieve the desired coloring effect.

Bottom discharge/embossing roller 96 is supported within roller cradle 61 of bottom portion 60 of the roller support frame by bearings 97. As bottom portion 60 of the roller support frame is adjusted vertically, so is bottom roller 96. Felt-wiper subassembly 40 is associated with bottom roller 96 to remove any ink that is deposited on roller 96 by a slat that has been colored by transfer roller 92.

Referring to FIGS. 7 and 8, doctor blade assembly 20 shall be described in further detail. Doctor blade assembly 20 is mounted to top portion 69 of the roller support frame such that top section 36 of a pivot support of the blade assembly aligns with bearing support 64 of frame top portion 69 to enclose fully a bearing connected to the support shaft of Anilox Roller 90. Bottom section 37 of the pivot support is rotatably mounted to pivot support mounts 56 of frame top portion 69 to rotate outward and downward away from Anilox roller 90. Doctor blade assembly 20 is connected to top portion 69 of the roller frame support such that assembly 20 will adjust vertically along with top portion 69. When the pivot support is in its assembled position (as is shown in FIG. 5), Anilox roller 90, and transfer roller 92 are secured within frame top portion 69. When the pivot support and assembly 20 are rotated downward, rollers 90 and 92 can be removed. Pivot 23 is connected to the pivot support for rotational adjustment of the doctor blade relative to the pivot support. Stop block 25 and adjustment blocks 26 are located with pivot blocks 32, which are supported within the pivot support by end plates 31 to connect pivot 23 to the pivot support. Stop block 25 is connected to pivot 23 to limit the rotation of pivot 23 relative to the pivot support. Adjustment block 26 connects pivot 23 to the pivot support to provide horizontal adjustment of the doctor blade relative to Anilox roller 90. A clamp is attached to pivot block 32, including clamp handle 30 and lockdown bar 29. Clamp handle 30 rotates to press lockdown bar 29 against pivot 23 to prevent undesired rotation of pivot 23 during operation. Clamp collar 28 holds the clamp tight against pivot block 32.

Pivot arm 33 is connected to pivot 23 for rotation with pivot 23. Wiper blade holder 21 is connected to pivot arm 33. Upper wiper blade 35 is attached to the top of wiper blade holder 21, and a lower wiper blade is attached to the bottom of wiper blade holder 21. Side strips 22 are connected to wiper blade holder 21 extending downward from each side of upper wiper blade 35 and the lower wiper blade. In the embodiment shown, upper wiper blade 35 and the lower wiper blade both have a length generally equal to, or slightly greater than the axial length of Anilox roller 90, such that upper wiper blade 35, the lower wiper blade, and side strips 22 partially enclose a portion of Anilox roller 90. Ink is injected into the enclosed area and onto Anilox roller 90 through ink ports 34. As roller 90 rotates, upper wiper blade 35 (or the lower wiper blade, depending upon the direction of rotation) scrapes excess ink away from full cells of the Anilox roller, evenly spreading the ink to all cells and allowing any remaining ink to drip into pan 24 which is held to the pivot support by pan rails 27. Side strips 22 prevent excess ink from building up on the ends of Anilox roller 90. Although upper wiper blade 35 and the lower wiper blade in the shown embodiment of the instant invention both have a length equal to or greater than the axial length of roller 90, it will be appreciated that shorter lengths may be utilized such that side strips 22 enclose only the surface of roller 90 instead of extending around the ends of the roller, if the entire axial length of the Anilox roller is not to be utilized.

Figures 9, 10:
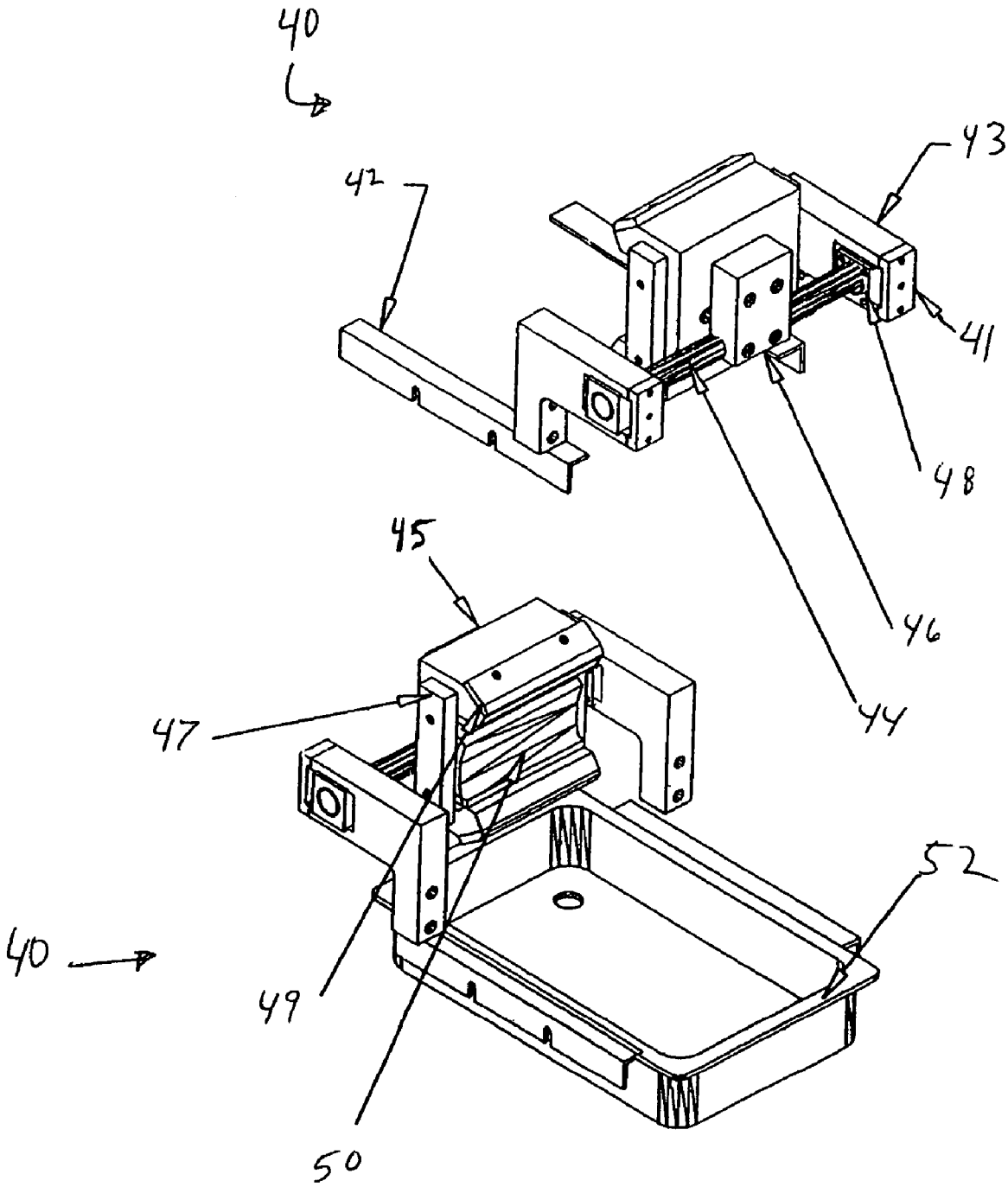
FIG. 9 is a front perspective view of a felt/wiper unit subassembly of the ink machine shown in FIG. 1.
FIG. 10 is a rear perspective view of the felt/wiper unit subassembly of FIG. 9.

Referring to FIGS. 9 and 10, felt-wiper subassembly 40 is described in further detail. Bracket 43 is connected to side plates 57 of bottom portion 60 of the roller support frame, such that wiper assembly 40 is vertically adjustable along with bottom roller 96 and bottom portion 60 of the roller support frame. Pivot 44 is mounted to bracket 43 for rotation relative to bracket 43. Pivot 44 is supported by pivot blocks 48, which are held within bracket 43 by end plates 41. Although not shown in the described embodiment, it will be appreciated that stop blocks, adjustment blocks, and clamps can be utilized in connection with pivot 44 in a manner similar to that described above with respect to pivot 23 for the doctor blade assembly.

Pivot arm 46 is connected to pivot 44 for rotation along with pivot 44. Holder 45 is connected to pivot arm 46. Holder 45 supports wiper blade 49 and also supports felt insert 50 below wiper blade 49. Side plates 47 are connected to holder 45 to prevent felt insert 50 from sliding sideways out of holder 45. It will be appreciated that felt insert 50 may be a fabric material of matted, compressed animal fibers, such as wool or fur, a fabric of similar materials mixed with vegetable or synthetic fibers, or any other material having suitable ink-retention/absorbent characteristics.

Bottom roller 96 rotates as slats are fed through machine 10 between bottom roller 96 and embossing roller 94. Any excess ink that is deposited on bottom roller 96 by slats that have been colored is cleaned off of roller 96 by a combination of felt 50, top wiper blade 49, and a bottom wiper blade (located below felt 50). The bottom of bottom roller 96 dips into drip pan 52, which is supported to bracket 43 by pan support bracket 42. Any ink that is deposited on bottom roller is diluted by the water in drip pan 52 (or the water picked up by bottom roller 96 as it travels through drip pan 52), scraped off by the first wiper blade contacting the surface, scrubbed and further diluted by felt 50 and then further scraped by the second wiper blade contacting the surface of bottom roller 96.

Figure 11:
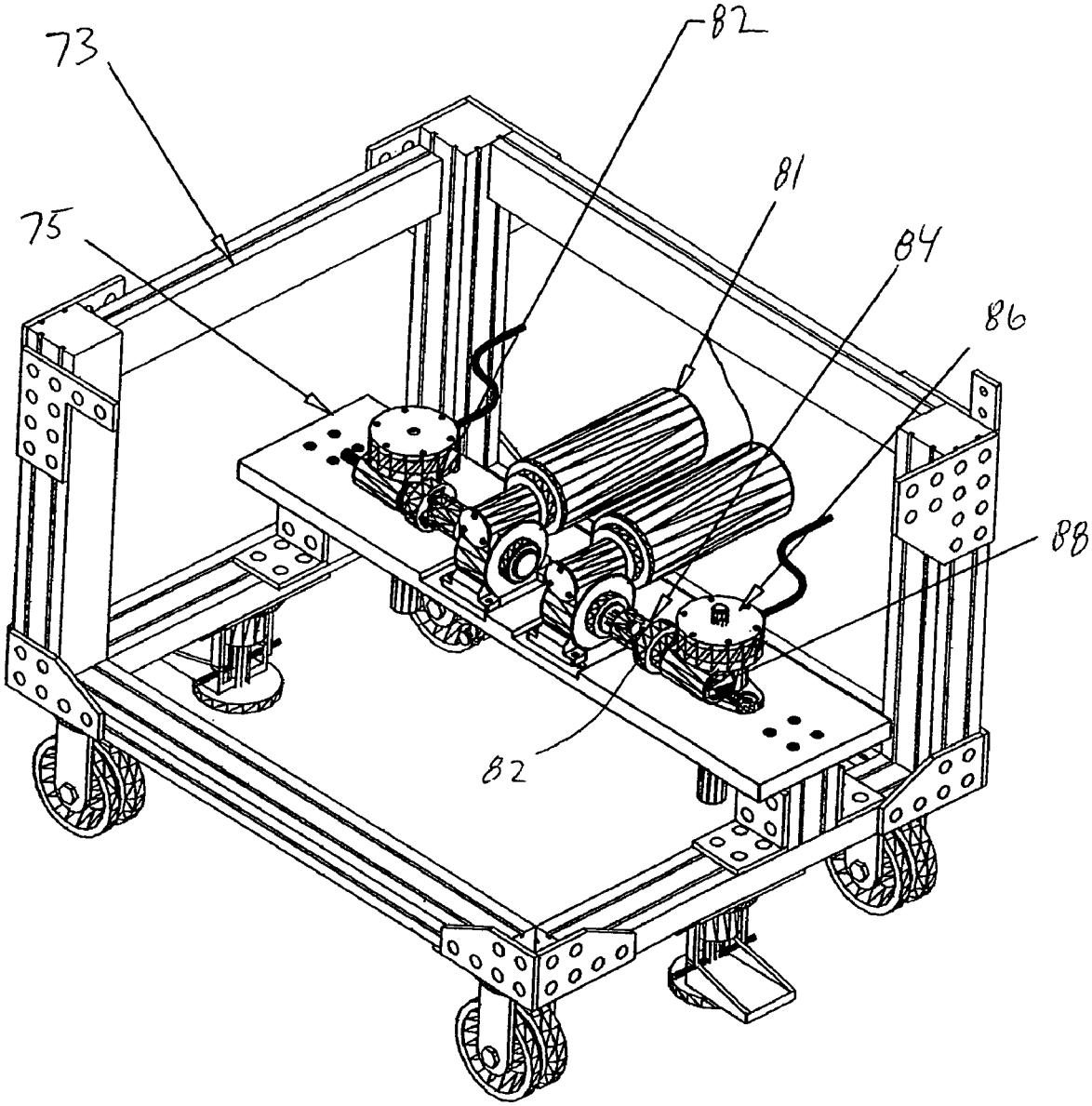
FIG. 11 is a partial front perspective view of the ink machine of FIG. 1 showing a bottom roller lift unit subassembly.

Referring to FIG. 11, the lifting mechanism for vertically adjusting bottom roller 96 (also roller support bottom portion 60, and felt-wiper assembly 40) for machine 10 is described in further detail. Lift support plate 75 is connected to base 73. Each bottom roller 96 (one in roller assembly 18 and one in roller assembly 19) is adjusted vertically by a lift assembly that raises and lowers bottom plate 68 of roller support bottom portion 60. Each lift assembly includes a gear motor, 81, a load cell, 86, a load cell plate, 82, a clutch, 84, and an actuator, 88. When desired to raise and/or lower bottom roller 96, actuator 88 activates gear motor 81 to move bottom plate 68 accordingly. Load cell 86 indicates the pressure created between bottom roller 96 and embossing roller 94 so that bottom roller 96 may be adjusted to the position necessary to achieve the desired embossing effect on the PVC slat.

In operation of machine 10 a variety of colorants may be used, including but not limited to water based or solvent based inks. Referring to FIG. 1, a PVC slat is fed from an extruder located to the right of machine 10 between embossing roller 94 and transfer roller 92 of roller assembly 19. The slat is then fed between embossing roller 94 and transfer roller 92 of roller assembly 18. The slat continues to between bottom roller 96 and embossing roller 94 of roller assembly 18, and between bottom roller 96 and embossing roller 94 of roller assembly 19 where it is discharged from machine 10 to a heat box.

It will be appreciated that although machine 10 has been shown and described so as to include two separate coloring and embossing stages for a single slat, the same machine can also be utilized to provide only one coloring and one embossing stages, one coloring and two embossing stages, two coloring and one embossing stages, two coloring and no embossing stages, one coloring and no embossing stages, no coloring and one embossing stages, or no color and two embossing stages. Machine 10 may be modified to provide one coloring and one embossing stage by replacing embossing roller 94 with a blank roller. In such case, the blank roller would help guide the slat through machine 10 and Anilox roller 90, transfer roller 92, and bottom roller 96 would all be unnecessary for that particular roller assembly (i.e. both the coloring and embossing stages would be accomplished in one roller assembly). It will also be appreciated that machine 10 may work together with other components and/or machines to complete the coloring and embossing stages. Such additional components/machines include, but are not limited to, extruders, cooling tables, heat boxes, and the like.

Although the foregoing detailed description of the present invention has been described by reference to an exemplary embodiment, and the best mode contemplated for carrying out the present invention has been shown and described, it will be understood that modification or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

What is claimed is:

1. An apparatus for coloring generally planar objects comprising:

an anilox roller connected to a support frame;

a doctor blade assembly connected to said support frame, said doctor blade assembly comprising:

a wiper blade having a length generally corresponding to an axial length of said anilox roller and adapted to scrape the surface of said anilox roller, a first side strip adjacent a first end of said wiper blade, and a second side strip adjacent a second end of said wiper blade, said second end opposing said first end;

a transfer roller connected to said support frame, said transfer roller located adjacent said anilox roller and adapted to receive a colorant from said anilox roller; and an embossing roller connected to said support frame, said embossing roller located adjacent said transfer roller;

wherein said transfer roller and said embossing roller are adapted to compress a generally planar object therebetween, so that the transfer roller may transfer the colorant to one surface of said generally planar object and the embossing roller may emboss a pattern on the opposed surface of said generally planar object.

2. The apparatus of claim 1, wherein said wiper blade, said first side strip and said second side strip are adapted to enclose at least a portion of said anilox roller.

3. The apparatus of claim 1, further comprising an adjustable mount connecting said doctor blade assembly to the support frame.

4. The apparatus of claim 3 wherein said adjustable mount comprises a pivot.

5. The apparatus of claim 4 further comprising a stop block connected to said pivot and an adjustment block generally adjacent said stop block.

6. The apparatus of claim 4 further comprising a clamp connected to said pivot.

7. The apparatus of claim 1, further comprising a discharge roller located downstream from said transfer roller, said discharge roller being configured to contact the surface of said generally planar object that has been colored by said transfer roller.

8. The apparatus of claim 7, further comprising a wiper unit assembly for said discharge roller, said wiper unit assembly comprising:

a discharge roller wiper blade having a length generally corresponding to a length of said discharge roller and adapted to wipe the surface of the discharge roller; and a felt surface generally adjacent said discharge roller wiper blade.

9. The apparatus as claimed in claim 7 wherein said discharge roller is an additional embossing roller.

* * * * *